US012078037B2

(12) United States Patent
Rodriguez et al.

(10) Patent No.: US 12,078,037 B2
(45) Date of Patent: Sep. 3, 2024

(54) CASING TRACTOR APPARATUS, SYSTEM, AND METHOD

(71) Applicant: Saudi Arabian Oil Company, Dhahran (SA)

(72) Inventors: Victor Jose Bustamante Rodriguez, Abqaiq (SA); Sajid Hussain, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 29 days.

(21) Appl. No.: 18/048,146

(22) Filed: Oct. 20, 2022

(65) Prior Publication Data

US 2024/0133272 A1 Apr. 25, 2024
US 2024/0229613 A9 Jul. 11, 2024

(51) Int. Cl.
*E21B 43/10* (2006.01)
*E21B 23/00* (2006.01)

(52) U.S. Cl.
CPC ..... *E21B 43/10* (2013.01); *E21B 23/001* (2020.05)

(58) Field of Classification Search
CPC .... E21B 23/001; E21B 23/08; E21B 41/0085; E21B 43/10
See application file for complete search history.

(56) References Cited

U.S. PATENT DOCUMENTS 5,692,563 A 12/1997 Krueger et al.
6,032,748 A 3/2000 DeBray et al.
6,868,913 B2 * 3/2005 Vidrine ..... E21B 23/04 405/184
8,590,615 B2 * 11/2013 Stokka ..... E21B 17/1014 175/263
2004/0060709 A1 * 4/2004 Vidrine ..... E21B 23/04 166/380
2005/0061518 A1 * 3/2005 Vidrine ..... E21B 23/08 166/380
2010/0224358 A1 * 9/2010 Stokka ..... E21B 43/12 166/180
2014/0174760 A1 * 6/2014 Slocum ..... E21B 23/00 166/241.1
2015/0218900 A1 * 8/2015 Hallundb ..... E21B 43/25 166/66.4
2020/0256146 A1 * 8/2020 Saint Germain ..... B60B 9/26

FOREIGN PATENT DOCUMENTS

CN 108625806 A * 10/2018 ..... E21B 17/1021
WO WO 1995021986 8/1995

* cited by examiner

*Primary Examiner* — Jennifer H Gay
(74) *Attorney, Agent, or Firm* — Fish & Richardson P.C.

(57) ABSTRACT

A downhole tractor assembly includes tubular main body configured such that a central axis of the main body is parallel with an axis of a tubing string when the tool is disposed in the tubing string. The tractor assembly includes a fluid flow passage within the main body, a turbine disposed in the flow passage, an alternator disposed in the main body and configured to convert the rotation of the turbine into electricity, one or more wheels extending radially at least partially from an exterior surface of the main body, and one or more electric motors configured to, when actuated by electricity from the alternator, drive rotation of the one or more wheels. The tractor assembly is configured to attach to a tubular string disposed in a wellbore, such that fluid flowed through the tubular string flows through the fluid passage and rotates the turbine.

13 Claims, 3 Drawing Sheets

CASING TRACTOR APPARATUS, SYSTEM, AND METHOD

TECHNICAL FIELD

This disclosure relates to the production of oil, gas, or other resources from subterranean zones to the surface.

BACKGROUND

Hydrocarbons trapped in subsurface reservoirs can be raised to the surface of the Earth (that is, produced) through wellbores formed from the surface to the subsurface reservoirs. Wells for hydrocarbon production or other applications can be completed and made ready for production by lowering and cementing a casing within the wellbore and inserting a production tubing string within the casing. Hydrocarbons or other fluids can be produced from a subterranean formation up through the production tubing string. In some circumstances, the lowering of the casing in the wellbore can be interrupted, difficult, or otherwise made problematic due to debris within the wellbore or other obstructions or restrictions.

SUMMARY

Certain aspects of the subject matter herein can be implemented as a system. The system includes a tubular string configured to be disposed within a wellbore drilled into a subterranean zone and a tractor assembly attached to the tubular string. The tractor assembly includes a tubular main body having a central axis parallel with an axis of the tubing string, a fluid flow passage within the main body configured to permit a flow of fluid flowing from tubular string through the tractor assembly, a turbine disposed in the flow passage and configured to be rotated by a flow of fluid from the tubular string through the fluid flow passage, an alternator disposed in the main body and configured to convert the rotation of the turbine into electricity, one or more wheels extending radially at least partially from an exterior surface of the main body, and one or more electric motors configured to, when actuated by electricity from the alternator, drive rotation of the one or more wheels.

An aspect combinable with any of the other aspects can include the following features. The tubular string can be a casing string.

An aspect combinable with any of the other aspects can include the following features. The tractor assembly can be disposed between a float collar and a casing shoe of the casing string.

An aspect combinable with any of the other aspects can include the following features. The one or more wheels can be components of a caterpillar tread.

An aspect combinable with any of the other aspects can include the following features. The fluid flow passage can have a central axis parallel with the axis of the tubular main body.

An aspect combinable with any of the other aspects can include the following features. The alternator can be disposed centrally within the fluid flow passage and a portion of the fluid flow passage at least partially surrounds the alternator.

Certain aspects of the subject matter herein can be implemented as a downhole tractor assembly that includes tubular main body configured such that a central axis of the main body is parallel with an axis of a tubing string when the tool is disposed in the tubing string. The tractor assembly includes a fluid flow passage within the main body, a turbine disposed in the flow passage, an alternator disposed in the main body and configured to convert the rotation of the turbine into electricity, one or more wheels extending radially at least partially from an exterior surface of the main body, and one or more electric motors configured to, when actuated by electricity from the alternator, drive rotation of the one or more wheels. The tractor assembly is configured to attach to a tubular string disposed in a wellbore, such that fluid flowed through the tubular string flows through the fluid passage and rotates the turbine.

An aspect combinable with any of the other aspects can include the following features. The tubular string can be a casing string and the tractor assembly can be configured to be attached to the casing string between a float collar and a casing shoe of the casing string.

An aspect combinable with any of the other aspects can include the following features. The fluid flow passage can have a central axis parallel with the axis of the tubular main body.

An aspect combinable with any of the other aspects can include the following features. The alternator can be disposed centrally within the fluid flow passage and a portion of the fluid flow passage can at least partially surrounds the alternator.

Certain aspects of the subject matter herein can be implemented as a method of operating a well system that includes a wellbore drilled into a subterranean zone. The method includes attaching a tractor assembly to a tubular string. The tractor assembly includes a tubular main body having a central axis parallel with an axis of the tubing string, a fluid flow passage within the main body configured to permit a flow of fluid flowing from tubular string through the tractor assembly, a turbine disposed in the flow passage and configured to be rotated by a flow of fluid from the tubular string through the fluid flow passage, an alternator disposed in the main body and configured to convert the rotation of the turbine into electricity, one or more wheels extending radially at least partially from an exterior surface of the main body, and one or more electric motors configured to, when actuated by electricity from the alternator, drive rotation of the one or more wheels. The method further includes disposing the tubular string in the wellbore and, in response to encountering an obstruction or restriction limiting movement of the tubular string in the wellbore, flowing a fluid through the tubular string and thence through the flow passage, thereby rotating the turbine and rotating the one or more wheels.

An aspect combinable with any of the other aspects can include the following features. The tubular string can be a casing string.

An aspect combinable with any of the other aspects can include the following features. Attaching the tractor assembly to the casing string can include attaching the tractor assembly between a float collar and a casing shoe of the casing string.

An aspect combinable with any of the other aspects can include the following features. Flowing the fluid can include circulating the fluid in a downhole direction through a central bore of the casing string and in an uphole direction within an annulus formed by at least partially by the outer surface of the casing string.

An aspect combinable with any of the other aspects can include the following features. The method can further include milling out components of the tractor assembly upon the tubular string reaching a final intended depth.

An aspect combinable with any of the other aspects can include the following features. The method can further include applying weight to the tubular string in response to the encountering the obstruction or restriction limiting movement of the tubular string.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

In some circumstances, a well operator may encounter difficulty in disposing a casing string or other tubular string at its intended or desired downhole depth due to debris, wellbore narrowing, or other restrictions or obstructions within the wellbore. In accordance with embodiments of the present disclosure, an apparatus, system, and method for mitigating problems or difficulty in casing movement and installation is disclosed. By enabling desired travel and movement of a casing string in spite of such restrictions or obstructions, operational costs can be reduced and the safety, effectiveness, efficiency of wellbore operations can be increased.

Figure 1:
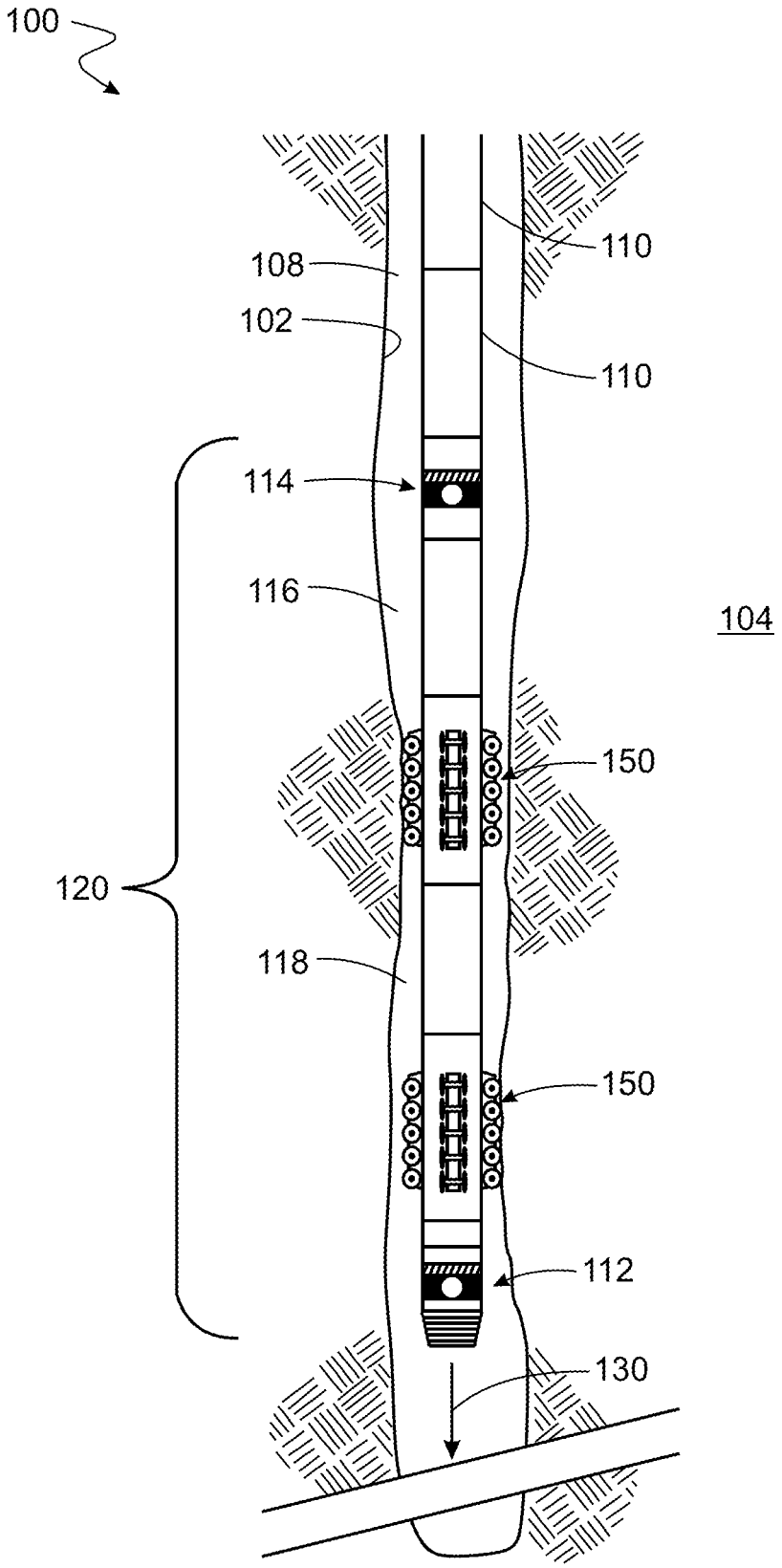
FIG. 1 is a schematic illustration of a well system in accordance with an embodiment of the present disclosure.

FIG. 1 is a schematic illustration of a well system in accordance with an embodiment of the present disclosure. Referring to FIG. 1, well system 100 includes a wellbore 102 drilled into a subterranean zone 104. Subterranean zone 104 can comprise various geological formations of different geometries and lithologies, and in some instances are stacked or layered in sedimentary layers. Some or all of subterranean zone 104 can be hydrocarbon producing zone (such as a porous and permeable limestone or sandstone reservoir). In the illustrated embodiment, wellbore 102 is a vertical well. In some embodiments, all or a portion of wellbore 102 can be deviate from vertical; for example, be horizontal or approximately horizontal.

So as to isolate all or a portion of wellbore 102 from all or a portion of subterranean zone 104 (for example, to protect a freshwater aquifer from wellbore fluids or to prevent the wellbore walls from collapsing into the wellbore), a casing string 108 can be lowered into wellbore 102. Casing string 108 can comprise one or more tubular casing segments 110. FIG. 1 shows casing string 108 as it is being lowered downhole, not yet having reached its final intended depth. During the lowering operation, a circulating fluid 130 (such as a drilling fluid) can be pumped downhole through the central bore of casing string 108, exiting through casing shoe 112 at the downhole end of casing string 108.

Upon reaching its intended depth, casing string 108 can be cemented into wellbore 102 using conventional methods. Specifically, in accordance with such conventional methods, a cement slurry can be pumped from the surface down the central bore of casing string 108. As the cement slurry travels downhole, a cementing plug (not shown) travels downhole atop the slurry within the central bore, separating the cement slurry from other wellbore fluids uphole of the cement slurry. The cementing plug can be comprised of rubber or another suitable material or materials. The cement exits casing string 108 at casing shoe 112, then traveling uphole along the exterior surface of casing string 108 to fill the annulus between casing string 108 and the inner surface of wellbore 102. The cement then solidifies within the annulus, thus permanently fixing the casing string in the wellbore. In some embodiments, a production string (not shown) can then be disposed within casing string 108 and fluids produced from the well through the production string. In other embodiments, no inner production tubing is installed such that produced fluids can travel uphole through casing string 112. In some embodiments, after installation of a casing string, drilling can continue downhole of the casing string by lowering a drill string through the central bore of the casing string, after the casing string is cemented into the wellbore. In the illustrated embodiment, only one casing string is shown. In some embodiments, a well system can include multiple casing strings, with progressively smaller-diameter strings extending downhole, each individually cemented into place in accordance with conventional methods.

The downhole portion of casing string 108 comprises shoe track 120 which includes, in addition to casing shoe 112, a float collar 114 uphole of casing shoe 112. Float collar 114 provides a landing point for the cementing plug as the cement slurry pumping job reaches completion. Float collar 114 can also include a check valve (such as a flapper-valve type, a spring-loaded ball valve or other suitable valve) so as to prevent reverse flow of cement or other fluids back into the central bore of the casing string. Shoe track 120 can also include one or more casing segments (such as casing segments 116 and 118) disposed between float collar 114 and casing shoe 112. In some embodiments, after a cementing job is complete and the majority of the cement slurry pumped downhole has exited the casing string and filled the annulus exterior to the casing string, a volume of cement is intentionally left remaining within shoe track 120, partially or fully filling casing segments 116 and 118 and the other components of shoe track 120 and ensuring closure of the downhole end of the casing string. The components of shoe track 120 can be milled- or drilled-through in the event further drilling or other operations are desired downhole of the casing shoe.

In some embodiments, the intended travel of casing string 108 in the downhole direction to its final intended depth can be made difficult or otherwise problematic due to debris within wellbore 102 or other obstructions or restrictions, particularly in relatively narrow portions of wellbore 102 and/or in those portions in which the wellbore 102 deviates from a relatively straight path. In such circumstances, the forces pushing casing string 108 in the downhole direction (such as force due to the weight of the casing string and its components) may not be sufficient to propel the casing string downhole past the obstructions or restrictions, causing a stuck casing string or other undesirable effects, resulting less efficient well operations, damage to (and/or increased wear and tear on) downhole components, increased costs, safety concerns, and other undesirable consequences.

In the illustrated embodiment, in accordance with some embodiments of the present disclosure, shoe track 120 includes one or more casing tractors 150. As described in more detail with respect to the following figures and the accompanying text, casing tractors 150 can in some embodiments each one or more wheels driven by an electric motor. In some embodiments, tractor assembly 150 can be as described in greater detail in reference to FIG. 2. In some embodiments, tractor assembly 150 can include some or all of the elements described in reference to FIG. 2, and/or can include other, fewer, or additional elements.

Figure 2:
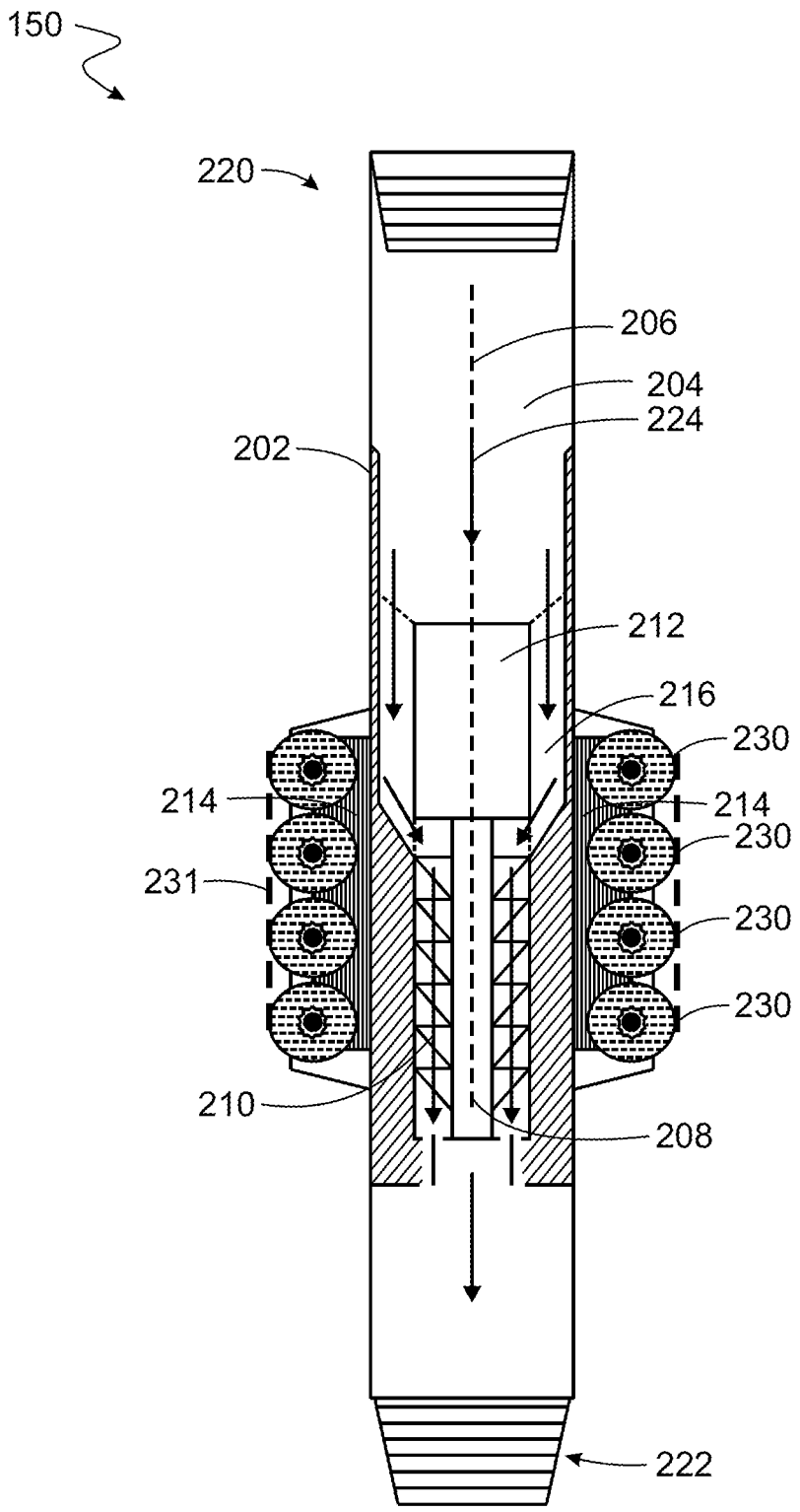
FIG. 2 is a schematic illustration of a casing tractor in accordance with an alternative embodiment of the present disclosure.

Referring to FIG. 2, casing tractor assembly 150 includes a main body 202 with a fluid flow passage 204 therethrough having an axis 206 parallel with the axis of the central bore of the casing string. The uphole end 220 of main body 202 can be connected to the casing segment, float collar, or other component of the shoe track uphole of casing tractor assembly 150, and the downhole end 222 of main body 202 can be connected to a casing segment, casing shoe, or other component of the shoe track downhole of casing tractor assembly 150, such that fluid (such as circulating fluid 224) flowing downhole through the shoe track can flow through flow passage 204 to exit at downhole end 222 and can thence exit the shoe track at the casing shoe.

In the illustrated embodiment, a turbine 208 is disposed within a narrowed portion of flow passage 204. Turbine 208 includes turbine blades 210 configured such that a flow of fluid through the fluid flow passage 204 imparts rotation to the turbine. Alternator 212 is disposed in main body 202 and is configured to convert the rotation of the turbine 208 into electricity. In the illustrated embodiment, alternator 212 is disposed centrally within fluid flow passage 204, a portion of fluid flow passage 204 at least partially surrounds alternator 212, and the axis of turbine 208 is also the axis of (i.e., it is coaxial with) central axis 206 of fluid flow passage 204.

One or more electric motors 214 are configured to, when actuated by electricity from the alternator 212, drive one or more wheels 230 wheels extending radially at least partially from an exterior surface of main body 202, as described in greater detail below. A plurality of legs 216 connect alternator 212 with main body 202, and the spaces between legs 216 allow for the fluid flow past the alternator 212 and across the blades of the turbine. Legs 216 and main body 202 can include ports or passageways through which can be disposed power cables and other wiring connecting alternator 212 with one or more electric motors 214, thus isolating the cables and wiring from corrosive wellbore fluids or otherwise harmful downhole conditions.

In some embodiments, when driven by electric motors 214, the frictional force imparted by wheels 230 against the interior surface of the wellbore (or downhole debris or other downhole parts or components of the well system) can provide additional force to dislodge or otherwise move the casing string through or past obstructions or restrictions in the wellbore.

In the illustrated embodiment, wheels 230 are arranged in two wheel sets on the exterior of main body 202 spaced 180 degrees apart (that is, 180 degrees apart about the circumference of the main body, such that the wheel sets are opposite each other across the diameter of the main body), and each wheel set includes four wheels arranged in-line, parallel to central axis 206, with each wheel set powered by a separate motor 214. In some embodiments, casing tractor assembly 150 can include a greater or lesser number of wheels or wheel sets in different configurations. For example, in some embodiments casing tractor assembly 150 can include three wheel sets spaced 120 degrees apart, or four wheel sets spaced 90 degrees apart. In some embodiments, such even circumferential spacing allows the wheel sets to act as centralizers (either alone or in combination with other centralizer components of the shoe track) to maintain the shoe track in a desired centralized configuration within the wellbore. Some embodiments can include wheels or wheel sets arranged in different configurations other than as in-line sets as illustrated. Whereas alignment of the wheels substantially parallel to the central axis 206 can effectively urge longitudinal movement of the casing parallel to the axis of the wellbore, which can in some circumstances be desirable to overcome debris or other restrictions or obstructions in some circumstances, rotational or other non-longitudinal movement of the casing can in some circumstances be desired so as to overcome such restrictions or obstructions, and in some embodiments some or all or some of the wheels can be aligned other than parallel to central axis 206 so as to urge such rotational or other non-longitudinal movement of the casing. In some embodiments, a single tractor or wheel set can include wheels align in more than one orientation and in some embodiments the wheels or wheel sets can be operated individually so as to provide an operator with the option to apply forces on the casing string in different directions depending on the nature and geometry of the restriction or obstruction encountered. In the illustrated embodiment, each motor 214 drives all the wheels of its respective wheel set. In some embodiments, a single wheel is driven by a single motor. In some embodiments, a single motor drives multiple wheel sets.

While in the illustrated embodiment the electric motors 214 are shown disposed on the exterior of main body 202, the electric motors can in some embodiments be disposed in another suitable location instead or in addition to the exterior of main body 202. In some embodiments, the wheels are configured to rotate freely in either direction when not driven to rotate in one direction by the electric motor. Wheels 230 can be comprised of Teflon or another suitable material. In some embodiments, wheels 230 can include caterpillar treads or projections to increase the frictional force.

Figure 3:
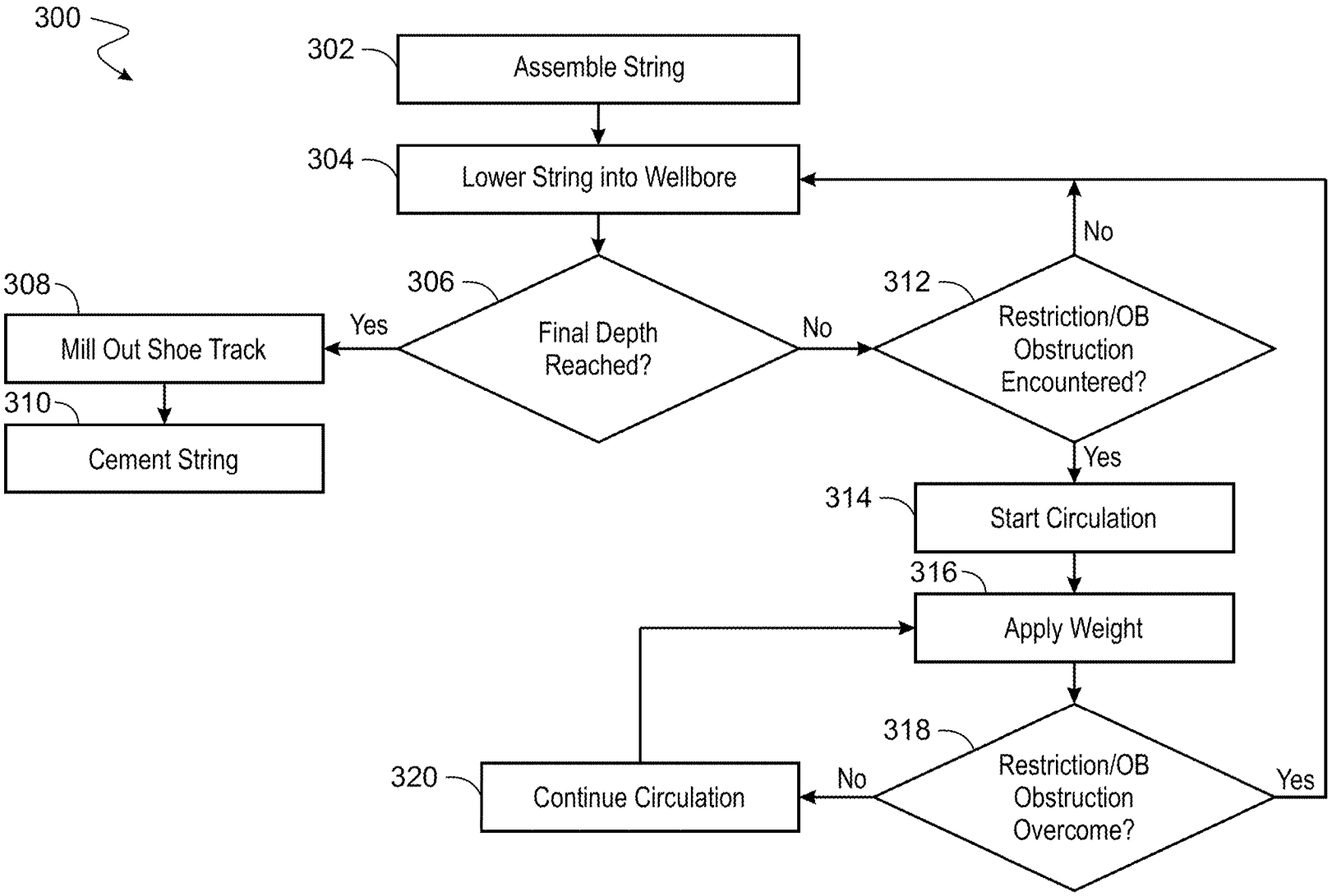
FIG. 3 is a process flow diagram of a method of operating a downhole vibration tool in accordance with an embodiment of the present disclosure.

While FIGS. 1 and 2 are described in reference to a casing string, in some embodiments, tractor assembly 150 can be attached to a tubular string other than a casing string (for example, a production tubing), and configured to urge movement of such tubular string in a similar manner as described above response to encountering an obstruction or restriction limiting movement of the tubular string in the wellbore, FIG. 3 is a process flow diagram of a method 300 of operating a well system. The steps of FIG. 3 will hereafter be described in reference to the casing string and other systems and apparatus of FIGS. 1 and 2. However, it will be understood that other tools and other apparatus components and systems can be used in other embodiments of the present disclosure, in the context of various different kinds and types of well systems. For example, while FIG. 3 is described in reference to a casing string, in some embodiments, the same or similar method can be used to urge movement of a tubular string other than a casing string, in a similar manner as described above response to encountering an obstruction or restriction limiting movement of the tubular string in the wellbore.

Method 300 begins at step 302 in which a tractor assembly is attached to a tubular string. The tubular string can be casing string 108 and the tractor assembly can be tractor assembly 150, as described in reference to FIGS. 1 and 2. The attachment can be as part of a casing make-up sequence on a rig rotary table. The first section of the casing string made up can be the casing shoe track, in some embodiments in the following order:

a. Float shoe
b. Joint of casing
c. Casing Shoe tractor sub, d. Float Collar (Back Up Float equipment)
e. Casing Shoe tractor sub
f. Float Collar—Where the cement plugs will land
g. Rest Of the casing Continuing to step 304, the casing string is disposed in the wellbore and lowered downhole. As the string is lowered downhole, fluid circulation may not be necessary and the wheels of the tractor assembly can rotate freely. The method continues to step 306 wherein a determination is made regarding whether the string has arrived at its final intended or desired depth. The determination at step 306 can occur continuously and/or periodically. If at step 306 the string has arrived at its final desired or intended depth, then, at step 308, a drill bit or milling bottomhole assembly can be run to drill or mill out the alternator, turbine, and other or the components inside the shoe track and proceeding to step 310 cementing or other suitable well operations can occur. In some embodiments, milling step 308 can occur after cementing. If at step 306 the final depth has not been reached, and if at step 312 no restriction or obstruction is encountered, then the method returns to step 304 and the lowering of the string continues. If at step 312 a restriction or obstruction is encountered, then, at step 314, the string can be picked up and fluid circulation started through the string. The fluid circulation rotates the turbine of the tractor assembly, powering the electric motors to drive the wheels of the tractor assembly as described above, thereby urging the string through the restriction or obstruction. Subsequently or at the same time, at step 316, some weight can be applied to the string to further urge the movement. If at step 318 the restriction or obstruction has been overcome, then the method returns to step 304 and the lowering of the string continues. If at step 314 the restriction has not been overcome, then circulation continues at step 320 and the method returns to step 316 as circulation continues and weight continues to be applied until the obstruction or restriction is overcome.

The term "uphole" as used herein means in the direction along a tubular string or the wellbore from its distal end towards the surface, and "downhole" as used herein means the direction along a tubular string or the wellbore from the surface towards its distal end. A downhole location means a location along the tubular string or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A system comprising:
a casing string configured to be disposed within a wellbore drilled into a subterranean zone;
a tractor assembly attached to the casing string between a float collar and a casing shoe of the casing string, the tractor assembly comprising:
a tubular main body having a central axis parallel with an axis of the casing string;
a fluid flow passage within the main body configured to permit a flow of fluid flowing from the casing string through the tractor assembly;
a turbine disposed in the flow passage and configured to be rotated by a flow of fluid from the casing string through the fluid flow passage;
an alternator disposed in the main body and configured to convert the rotation of the turbine into electricity;
one or more wheels extending radially at least partially from an exterior surface of the main body; and
one or more electric motors configured to, when actuated by electricity from the alternator, drive rotation of the one or more wheels.

2. The system of claim 1, wherein the one or more wheels are components of a caterpillar tread.

3. The system of claim 1, wherein the fluid flow passage has a central axis parallel with the axis of the tubular main body.

4. The system of claim 1, wherein the alternator is disposed centrally within the fluid flow passage and a portion of the fluid flow passage at least partially surrounds the alternator.

5. A downhole tractor assembly comprising:
a tubular main body configured such that a central axis of the main body is parallel with an axis of a casing string when the assembly is attached to the casing string between a float collar and a casing shoe of the casing string;
a fluid flow passage within the main body;
a turbine disposed in the flow passage;
an alternator disposed in the main body and configured to convert the rotation of the turbine into electricity;
one or more wheels extending radially at least partially from an exterior surface of the main body; and
one or more electric motors configured to, when actuated by electricity from the alternator, drive rotation of the one or more wheels, wherein the tractor assembly is configured such that, when the tractor assembly is attached to the casing string between the float collar and the casing shoe and the casing string is disposed in the wellbore, fluid flowed through the casing string flows through the fluid passage and rotates the turbine.

6. The downhole tractor assembly of claim 5, wherein the fluid flow passage has a central axis parallel with the axis of the tubular main body.

7. The downhole tractor assembly of claim 5, wherein the alternator is disposed centrally within the fluid flow passage and a portion of the fluid flow passage at least partially surrounds the alternator.

8. A method of operating a well system, the well system comprising a wellbore drilled into a subterranean zone, the method comprising:
attaching a tractor assembly to a casing string between a float collar and a casing shoe of the casing string, the tractor assembly comprising:
a tubular main body having a central axis parallel with an axis of the casing string;
a fluid flow passage within the main body configured to permit a flow of fluid flowing from casing string through the tractor assembly;
a turbine disposed in the flow passage and configured to be rotated by a flow of fluid from the casing string through the fluid flow passage;
an alternator disposed in the main body and configured to convert the rotation of the turbine into electricity;
one or more wheels extending radially at least partially from an exterior surface of the main body; and
one or more electric motors configured to, when actuated by electricity from the alternator, drive rotation of the one or more wheels;

disposing the casing string in the wellbore; and in response to encountering an obstruction or restriction limiting movement of the tubular string in the wellbore, flowing a fluid through the casing string and thence through the flow passage, thereby rotating the turbine and rotating the one or more wheels.

9. The method of claim 8, wherein flowing the fluid comprises circulating the fluid in a downhole direction through a central bore of the casing string and in an uphole direction within an annulus formed by at least partially by the outer surface of the casing string.

10. The method of claim 8, further comprising milling out components of the tractor assembly upon the tubular string reaching a final intended depth.

11. The method of claim 8, further comprising applying weight to the tubular string in response to the encountering the obstruction or restriction limiting movement of the tubular string.

12. A system comprising:

a tubular string configured to be disposed within a wellbore drilled into a subterranean zone;

a tractor assembly attached to the tubular string, the tractor assembly comprising:

a tubular main body having a central axis parallel with an axis of the tubular string;

a fluid flow passage within the main body configured to permit a flow of fluid flowing from tubular string through the tractor assembly;

a turbine disposed in the flow passage and configured to be rotated by a flow of fluid from the tubular string through the fluid flow passage;

an alternator disposed in the main body centrally within the fluid flow passage with a portion of the fluid flow passage at least partially surrounding the alternator, the alternator configured to convert the rotation of the turbine into electricity;

one or more wheels extending radially at least partially from an exterior surface of the main body; and one or more electric motors configured to, when actuated by electricity from the alternator, drive rotation of the one or more wheels.

13. A downhole tractor assembly comprising:

a tubular main body configured such that a central axis of the main body is parallel with an axis of a tubular string when the assembly is attached to the tubular string;

a fluid flow passage within the main body;

a turbine disposed in the flow passage;

an alternator disposed centrally within the fluid flow passage with a portion of the fluid flow passage at least partially surrounding the alternator, the alternator configured to convert the rotation of the turbine into electricity;

one or more wheels extending radially at least partially from an exterior surface of the main body; and one or more electric motors configured to, when actuated by electricity from the alternator, drive rotation of the one or more wheels, wherein the tractor assembly is configured such that, when the tubular string is disposed in the wellbore, fluid flowed through the tubular string flows through the fluid passage and rotates the turbine.

* * * * *